United States Patent [19]

Shiber

[11] 4,232,645

[45] Nov. 11, 1980

[54] VARIABLE GEOMETRY WHIRLER

[76] Inventor: Samuel Shiber, P.O. Box 371, Mundelein, Ill. 60060

[21] Appl. No.: 19,132

[22] Filed: Mar. 9, 1979

[51] Int. Cl.[3] ..... F02M 29/06

[52] U.S. Cl. ..... 123/590; 261/79 R; 48/180 R; 48/180 P; 48/180 B

[58] Field of Search ..... 123/141; 261/79 R; 48/180 R, 180 P, 180 B, 180 S

[56] References Cited

U.S. PATENT DOCUMENTS

| | | | |
|---|---|---|---|
| 1,568,410 | 1/1926 | Minter | 123/141 |
| 1,600,007 | 9/1926 | Mock | 123/141 |
| 2,093,959 | 9/1937 | Ericson | 123/141 |
| 3,048,378 | 8/1962 | Newman | 261/79 R |
| 3,499,427 | 3/1970 | August | 123/141 |
| 3,671,208 | 6/1972 | Meeleber | 261/79 R |
| 4,044,077 | 8/1977 | Gupta | 123/141 |
| 4,064,857 | 12/1977 | Williams | 123/141 |
| 4,137,886 | 2/1979 | Hiramatsu | 123/141 |

*Primary Examiner*—Ira S. Lazarus
*Attorney, Agent, or Firm*—Samuel Shiber

[57] ABSTRACT

In a throttlable induction manifold of an internal combustion engine a variable geometry whirler for homogenizing an explosive charge flowing there in, during a partially closed throttle operation, the geometry of said whirler adapted to change during an open throttle operation so that the whirling action and the flow restriction associated therewith are minimized.

7 Claims, 2 Drawing Figures

VARIABLE GEOMETRY WHIRLER

BACKGROUND & SUMMARY OF THE INVENTION

Common automotive internal combustion engines generate power output by exploding a charge of gasoline, air and in some cases additional inert gases (to control certain kinds of air pollutions) in an expandable chamber. It is well established in the art that homogenizing the charge is desirable in order to increase the power output and to decrease the air pollution. Numerous mixing means have been proposed over the years, however they introduced a certain inherent penalty by interfering with the flow through the induction manifold during an open throttle operation.

The present invention comprises a variable geometry whirler apparatus which homogenizes the explosive charge flowing through a throttlable induction manifold of an internal combustion engine when the throttle is partially open, i.e., in various internal combustion engines the restriction of the induction manifold is inherently required and the apparatus puts this phenomenon into good use. However, during an open throttle operation of the engine, the apparatus' geometry is varied so that the whirling and the restriction to flow associated with it are minimized and practically eliminated.

The variable geometry whirler can be installed in an induction manifold in addition to a conventional throttle, or it can be designed to assume the throttle's function in additon to its own function.

DETAILED DESCRIPTION OF THE FIGURES

Figure 1:
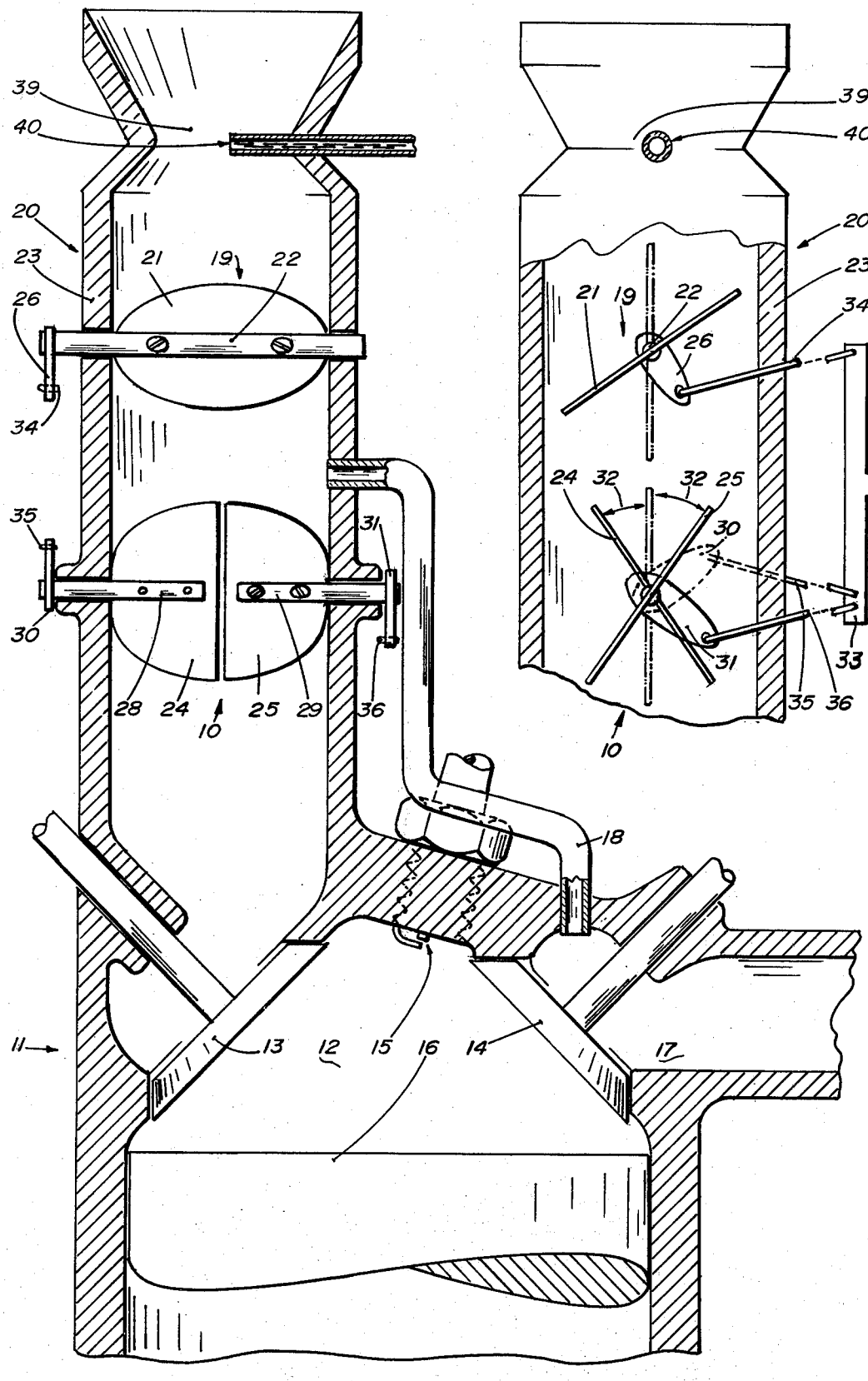
FIGS. 1 & 2 are a front view and a side view, respectively, of a variable geometry whirler apparatus installed in an engine's induction manifold.
Figure 2:
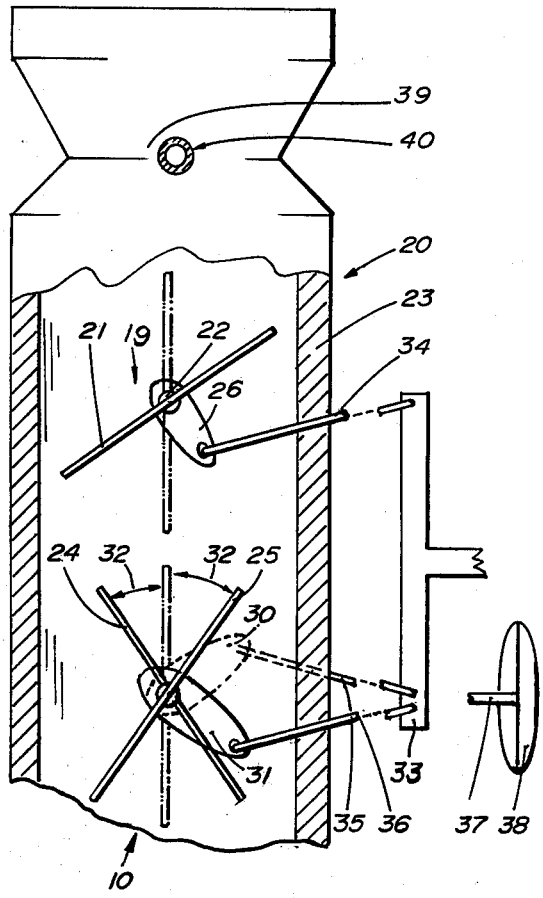

FIGS. 1 & 2 show an internal combustion engine 11 having a combustion chamber 12 equipped with an intake valve 13, an exhaust valve 14, a spark-plug 15 and a piston 16. The engine also comprises an exhaust manifold 17, an exhaust gas recirculating tube 18 and an induction manifold 20 for delivering an explosive charge into the chamber 12. The manifold 20 defines a venturi throat 39 and is equipped with a nozzle 40 for introducing gasoline into air flowing through the manifold 20. A conventional throttle 19 for selectively and variably closing and restricting flow through the manifold 20, comprising a thin rounded flat plate 21 affixed with screws to a shaft 22 which is attached to a lever 26 and which is rotatably supported by a wall 23 of the manifold 20.

A variable geometry whirler apparatus 10 is also disposed in the manifold 20 for mixing and homogenizing the explosive charge which contains gasoline, air and some exhaust gas. The apparatus 10 comprises two crescent shaped flat segments 24, 25, each affixed with screws to its shaft 28, 29, respectively, with each of said shafts attached to its lever 30, 31, respectively.

The segments 24, 25 are set in a parallel position to the direction of flow through the manifold 20 when the throttle 19 is fully open, as illustrated in phantom lines in FIG. 2. In this position the apparatus' whirling action is minimal. The segments 24, 25 are adapted to vary their position and form an angle 32 with the parallel position, and to thereby jointly define a spiral flow path in the manifold 20 for the charge to whirl and homogenize when the throttle 19 is partially open (as shown in solid lines in FIG. 2). As the angle 32 is increased the segments 24, 25, increasingly restrict the flow through the manifold until they substantially close it when they reach a position perpendicular to their above mentioned parallel position. Therefore, the apparatus 10 can also assume the function of the throttle 19, and the throttle 19 may be eliminated.

A vertical bar 33 which may be shifted right or left and which is connected by rods 34, 35, 36, to levers 26, 30, 31, respectively, serves to vary the positions of the plate 21 and the segments 24, 25, and also to link them one to the other, synchronizing their action. Alternatively, rods 35, 36 can be disconnected from the bar 33 and connected instead to a shaft 37 of a linear vacuum servo motor 38, which in turn can be connected via a hose (not shown) to the negative pressure prevailing in the manifold 20 between the apparatus 10 and intake valve 13, or the hose can be connected to the negative pressure prevailing in the venturi throat which corresponds to the flow rate through the manifold 20.

While the present invention was illustrated by a single embodiment, it should be understood that various modifications and variations can be made without departing from the spirit of the invention or the scope of the claims, for example:

The range of the angle 32 and the program according to which it is varied relative to the position of the throttle 19 can be modified. As illustrated in FIG. 2, the levers 30, 31, are longer than the lever 26 so that when the throttle 19 is closed the angle 32 is 45 degrees. Alternatively, the angle 32 may be maintained at a certain prefered value for optimal whirling action until the throttle is almost fully open, or fully open, and then the segments 24, 25 can be brought to their parallel position.

The segments 24, 25 preferably have a crescent shape, and they may be parts of a circle. When the angle 32 is large, the segments may be made to overlap one another (as viewed through the venturi throat 39), however, in cases where the apparatus also serves as a throttle care should be taken to prevent the negative pressure prevailing in the manifold 20 from exerting forces on the segments (due to the overlap) which will interfere with the smooth operation of the apparatus. The number of segments utilized in the apparatus is governed by practical considerations. A large number of segments may improve the whirling, but it tends to increase complexity and the restriction to flow in the parallel position.

The engine 11, which is partially shown in FIG. 1 may be a single or a multi-cylinder unit. The cross-sectional shape of the manifold 20 can be round as shown in the FIGURES, eliptical, etc., and the elements of the throttle and of the apparatus will then be affected in a manner obvious to one skilled in the art.

I claim:

1. In an internal combustion engine having a combustion chamber, an induction manifold for delivering an explosive charge into said chamber and a throttle means disposed in said manifold for selectively and variably closing and restricting flow through said manifold, the improvement wherein a variable geometry whirling creating apparatus is disposed in said manifold for mixing and homogenizing said explosive charge when said throttle is partially open, said apparatus adapted to vary its geometry and to minimize its whirling creating action when said throttle is fully open.

2. An apparatus as in claim 1, wherein said throttle and said apparatus are mechanically linked one to another.

3. An apparatus as in claim 1, wherein said geometry is varied according to a flow rate of said charge through said manifold.

4. An apparatus as in claim 1, wherein said geometry is varied according to a negative pressure prevailing in said manifold.

5. An apparatus as in claim 1 comprising at least two flat segments set in a parallel position to the direction of the flow through said manifold when said throttle is fully open, said segments adapted to vary their position and form an angle with said parallel position and to thereby jointly define a spiral flow path in said manifold when said throttle is partially open.

6. An apparatus as in claim 5, adapted to variably and selectively restrict flow through said manifold, and to substantially close it when said segments are set in a perpendicular position to said parallel position so that said apparatus also functions as said throttle means.

7. An apparatus as in claim 5, wherein said segment has a cresent shape.

* * * * *